US011614056B2

(12) United States Patent
Kong et al.

(10) Patent No.: US 11,614,056 B2
(45) Date of Patent: Mar. 28, 2023

(54) APPARATUS AND METHOD FOR THROTTLE VALVE HEATING CONTROL OF EXHAUST GAS RECIRCULATION (EGR) SYSTEM FOR COMBUSTION ENGINE

(71) Applicants: Hyundai Motor Company, Seoul (KR); Kia Corporation, Seoul (KR)

(72) Inventors: JeongEui Kong, Gyeonggi-do (KR); Hee Yong Choi, Gyeonggi-Do (KR); Ilsin Na, Incheon (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/503,859

(22) Filed: Oct. 18, 2021

(65) Prior Publication Data

US 2022/0282689 A1 Sep. 8, 2022

(30) Foreign Application Priority Data

Mar. 2, 2021 (KR) ..... 10-2021-0027176

(51) Int. Cl.

| | |
|---|---|
| ***F02M 26/73*** | (2016.01) |
| ***F02M 26/74*** | (2016.01) |
| ***F02D 9/02*** | (2006.01) |
| ***F02D 41/06*** | (2006.01) |
| *F02M 26/35* | (2016.01) |

(52) U.S. Cl.

CPC ..... *F02M 26/73* (2016.02); *F02D 9/02* (2013.01); *F02D 41/062* (2013.01); *F02M 26/74* (2016.02); *F02D 2200/0414* (2013.01); *F02M 26/35* (2016.02)

(58) Field of Classification Search

None

See application file for complete search history.

(56) References Cited

U.S. PATENT DOCUMENTS 6,595,185 B2 * 7/2003 Michels ..... F02M 31/10 123/399
6,923,157 B2 * 8/2005 Torii ..... F16K 1/225 251/305

(Continued)

FOREIGN PATENT DOCUMENTS

DE 10114221 A1 * 10/2002 ..... F02D 9/10
DE 102004014700 A1 * 11/2004 ..... F02D 9/104

(Continued)

*Primary Examiner* — Kevin R Steckbauer
(74) *Attorney, Agent, or Firm* — Fox Rothschild LLP

(57) ABSTRACT

A throttle valve heating control apparatus of an exhaust gas recirculation (EGR) system for a combustion engine includes a heat source installed in a valve housing and operated when receiving a voltage from a battery of a vehicle, a first sensor unit configured to measure a temperature of outside air of the vehicle, a second sensor unit configured to measure the voltage of the battery, and a controller configured to selectively control an operation of the heat source when the temperature of the outside air and the voltage satisfy a predetermined condition in a state in which the vehicle is turned on, and to determine whether an operation of the heat source is maintained through re-comparison of the temperature of the outside air in a state in which the heat source is operated.

9 Claims, 3 Drawing Sheets

(56) References Cited

U.S. PATENT DOCUMENTS

| | | | | | |
|---|---|---|---|---|---|
| 7,661,405 | B2 * | 2/2010 | Matsuura | F02D 9/10 | 137/171 |
| 2002/0152988 | A1 * | 10/2002 | Michels | F02M 15/022 | 123/399 |
| 2004/0187844 | A1 * | 9/2004 | Torii | F16K 1/225 | 251/305 |
| 2008/0053401 | A1 * | 3/2008 | Kondo | F02D 9/108 | 123/337 |
| 2009/0056671 | A1 * | 3/2009 | Matsuura | F02D 9/104 | 123/337 |

FOREIGN PATENT DOCUMENTS

| | | | | | |
|---|---|---|---|---|---|
| DE | 102007042074 | A1 * | 3/2008 | F02D 9/1035 | |
| EP | 1243774 | A2 * | 9/2002 | F02D 9/10 | |
| EP | 1243774 | B1 * | 7/2007 | F02D 9/10 | |
| EP | 2031215 | A1 * | 3/2009 | F02D 9/10 | |
| EP | 2031215 | B1 * | 12/2009 | F02D 9/10 | |
| GB | 2037894 | A * | 7/1980 | F02D 9/10 | |
| GB | 2319561 | A * | 5/1998 | F02M 31/13 | |
| JP | 2001090620 | A * | 4/2001 | F02M 15/022 | |
| JP | 2001303982 | A * | 10/2001 | F02M 15/02 | |
| JP | 2002309967 | A * | 10/2002 | F02D 9/10 | |
| JP | 2002349294 | A * | 12/2002 | | |
| JP | 2005-116474 | A | 4/2005 | | |
| JP | 2008063959 | A * | 3/2008 | F02D 9/1035 | |
| JP | 2008106707 | A * | 5/2008 | | |
| JP | 2008138530 | A * | 6/2008 | | |
| JP | 4146147 | B2 * | 9/2008 | F02D 9/10 | |
| JP | 2008255894 | A * | 10/2008 | | |
| JP | 2009-036110 | A | 2/2009 | | |
| JP | 2009036110 | A * | 2/2009 | | |
| JP | 2009052512 | A * | 3/2009 | F02D 9/10 | |
| JP | 2010090825 | A * | 4/2010 | | |
| JP | 4508386 | B2 * | 7/2010 | | |
| JP | 4630318 | B2 * | 2/2011 | F02D 9/10 | |
| JP | 5342595 | B2 * | 11/2013 | F16K 1/2266 | |
| JP | 5342595 | B2 | 11/2013 | | |
| JP | 2022034308 | A * | 3/2022 | | |
| KR | 2020-0070694 | A | 6/2020 | | |
| KR | 2020070694 | A * | 6/2020 | F02B 29/0475 | |
| WO | WO-0190550 | A1 * | 11/2001 | F02D 9/101 | |

* cited by examiner

APPARATUS AND METHOD FOR THROTTLE VALVE HEATING CONTROL OF EXHAUST GAS RECIRCULATION (EGR) SYSTEM FOR COMBUSTION ENGINE

CROSS-REFERENCE TO RELATED APPLICATION

This application claims under 35 U.S.C. § 119(a) the benefit of Korean Patent Application No. 10-2021-0027176 filed on Mar. 2, 2021, the entire contents of which are incorporated herein by reference.

BACKGROUND

(a) Technical Field

The present disclosure relates to an apparatus and method for throttle valve heating control of an exhaust gas recirculation (EGR) system for a combustion engine, more particularly, to the apparatus and method for throttle valve heating control of the EGR system for the combustion engine that are configured to prevent an inside of a throttle valve from freezing during low temperature conditions of outside air.

(b) Description of the Related Art

Recently, reduction of pollutants discharged from automobiles in accordance with environmental regulations is one of the biggest goals of research and development in the global automotive industry.

In particular, nitrogen oxide (hereinafter NOx) is a major air pollutant that not only causes acid rain but also irritates the eyes and respiratory tract and kills plants.

Thus, an exhaust gas recirculation ("EGR") system is installed in a vehicle in order to reduce NOx included in exhaust gas of the vehicle and for lowering the maximum temperature during combustion and preventing NOx from being formed by recirculating some (e.g., 5 to 40%) of exhaust gas and mixing the recirculated gas with fresh intake air.

That is, since exhaust gas (i.e., EGR gas) is substituted with some fresh intake air and is mixed therewith, the heat capacity of an air-fuel mixture is increased to prevent temperature rise of combustion gas in a cylinder of an engine, and an excess air ratio (coefficient) in the cylinder of the engine is lowered, and accordingly, total NOx generation is reduced by preventing thermal NOx from being generated.

An EGR valve applied to an EGR system is installed at a front end of a turbocharger, and an EGR cooler for cooling recirculated exhaust gas is installed at an outlet of the EGR valve and is connected to an intake line.

Accordingly, exhaust gas at a high pressure across the front end of the turbocharger is recirculated in the engine through the EGR valve and the EGR cooler and lowers the combustion temperature of the engine, thereby reducing generation of NOx.

EGR gas contains a lot of moisture, and in contrast, outside air passing through the turbocharger and an intercooler generally has a lower temperature, and in particular, in winter, the initial temperature may be below 0° C.

Thus, when outside air at a low temperature is mixed with EGR gas with a large amount of moisture in the intake line, moisture in the EGR gas may freeze due to the low temperature of the outside air, and ice formed through freezing may fix a shaft of a throttle valve connected to one side of the intake line to hinder opening and closing of the throttle valve, and accordingly, there is a problem in that it is impossible to normally drive a vehicle.

When ice formed through freezing accumulates inside the intake line, an inside diameter of the intake line is reduced, and thus there is a problem in that an under boost phenomenon such as power drop or acceleration failure occurs.

In order to overcome the above problem in terms of freezing, when an engine idles until sufficiently warmed, there is a problem in that fuel efficiency is degraded and a driver is inconvenienced.

SUMMARY

In one aspect, the present disclosure provides an apparatus and method for throttle valve heating control of an exhaust gas recirculation (EGR) system for a combustion engine for preventing a problem of a heater being damaged due to overcurrent and also preventing a problem of freezing of an inside of a valve housing by installing the heater in the valve housing, and applying a voltage to the heater and selectively operating the heater when the temperature of outside air is equal to or less than a setting temperature and the voltage of the battery of the vehicle applied for operating the heater is equal to or less than a setting voltage in the state in which an engine is turned on.

An embodiment of the present disclosure provides a throttle valve heating control apparatus of an exhaust gas recirculation (EGR) system for a combustion engine, the apparatus including a heat source installed in a valve housing and operated upon receiving a voltage from a battery of a vehicle, a first sensor unit configured to measure a temperature of outside air of the vehicle, a second sensor unit configured to measure the voltage of the battery, and a controller configured to selectively control an operation of the heat source when the temperature of the outside air and the voltage satisfy a predetermined condition in a state in which the vehicle is turned on, and to determine whether an operation of the heat source is maintained through re-comparison of the temperature of the outside air in a state in which the heat source is operated.

The heat source may include a positive temperature coefficient (PTC) heater formed like a film and installed on an inner circumference of the valve housing.

The heat source may transfer heat to a thermal conductor of a rotation shaft rotatably installed on a valve flow channel of the valve housing upon receiving the voltage of the battery.

Another embodiment of the present disclosure provides a throttle valve heating control method of an exhaust gas recirculation (EGR) system for a combustion engine, the method comprising: measuring an outside air temperature and then comparing the outside air temperature with a first setting temperature when a vehicle is turned on, measuring a voltage of a battery of the vehicle and comparing the voltage with a setting voltage when the outside air temperature is equal to or less than the first setting temperature and controlling a heat source operation to selectively apply the voltage of the battery to a heat source installed inside a valve housing when the outside air temperature is equal to or less than the first setting temperature and the voltage of the battery is equal to or less than the setting voltage.

The heat source operation control operation may include an outside air temperature re-comparison operation of comparing the outside air temperature with a second setting temperature when receiving the voltage of the battery, and performing control to maintain application of the voltage of the battery and to repeatedly perform the battery voltage comparison operation when the outside air temperature is equal to or less than the second setting temperature.

The outside air temperature re-comparison operation may include performing control to terminate application of the voltage of the battery when the outside air temperature is equal to or greater than the second setting temperature.

The second setting temperature may be set to be higher than the first setting temperature.

The heat source operation control operation may include determining whether the voltage of the battery is applied when the voltage of the battery is equal to or greater than the setting voltage.

The determining may include a voltage application time comparison operation of comparing a voltage application time of the battery, containing a time during which the battery voltage comparison operation is repeatedly performed, with a setting time and performing control to selectively apply the voltage to the battery when determining that the voltage of the battery is applied.

The voltage application time comparison operation may include performing control to apply the voltage of the battery when the voltage application time of the battery is equal to or greater than the setting time.

The voltage application time comparison operation may include performing control to terminate application of the voltage of the battery when the voltage application time of the battery is equal to or less than the setting time.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

DETAILED DESCRIPTION

Figure 1:
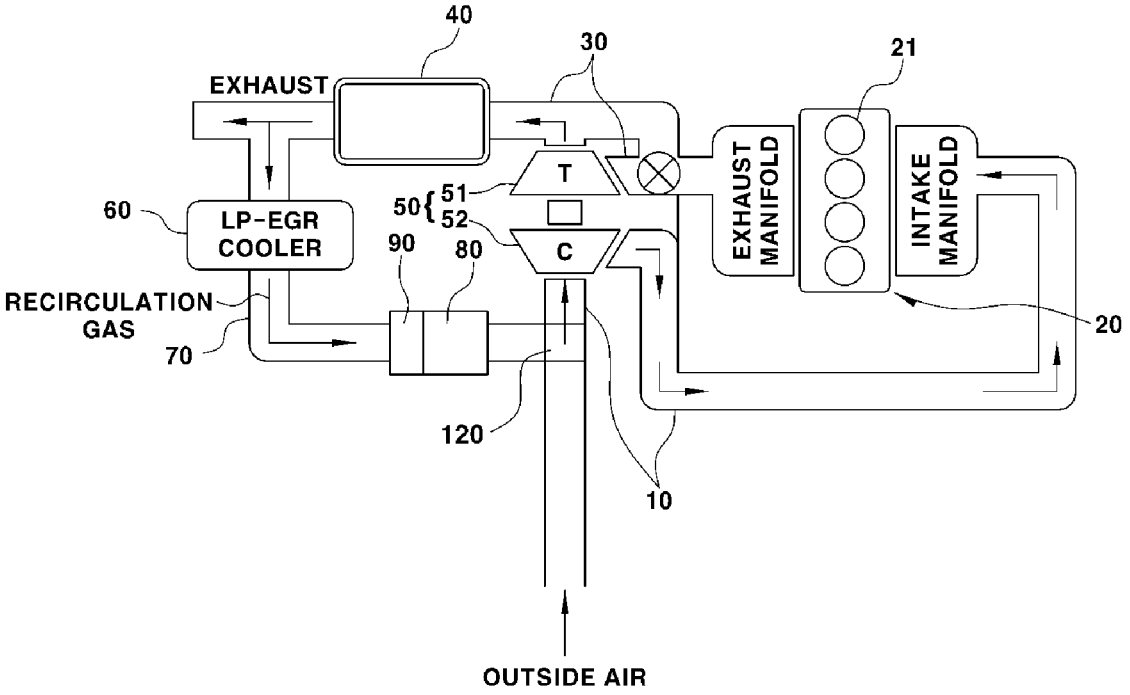
FIG. 1 is a diagram showing the configuration of a typical engine system according to the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described in detail with reference to the accompanying drawings.

Advantages and features of the present disclosure, and a method of achieving the same will become apparent with reference to the embodiments described below in detail together with the accompanying drawings.

The present disclosure may, however, be embodied in many different forms and should not be construed as being limited to the embodiments set forth herein; rather, these embodiments are provided so that this disclosure will be thorough and complete, and will fully convey the concept of the present disclosure to those skilled in the art, and the present disclosure is only defined by the scope of the claims.

In the description of the present disclosure, certain detailed explanations of related art are omitted when it is deemed that they may unnecessarily obscure the essence of the present disclosure.

Figure 2:
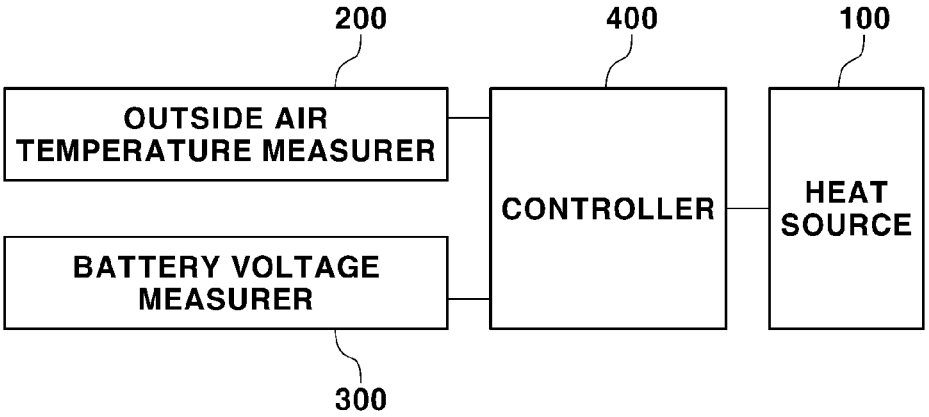
FIG. 2 is a diagram showing the configuration of a throttle valve heating control apparatus of an exhaust gas recirculation (EGR) system for a combustion engine according to an embodiment of the present disclosure.

FIG. 1 is a diagram showing the configuration of a typical engine system according to the present disclosure. FIG. 2 is a diagram showing the configuration of a throttle valve heating control apparatus of an exhaust gas recirculation (EGR) system for a combustion engine according to an embodiment of the present disclosure.

Figure 3:
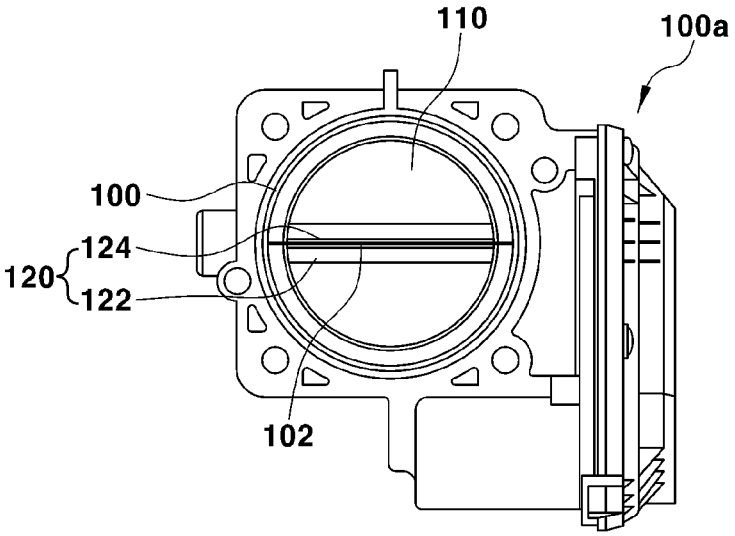
FIG. 3 is a perspective cross-sectional view showing a heat source of a throttle valve heating control apparatus of an EGR system for a combustion engine according to an embodiment of the present disclosure.
Figure 4:
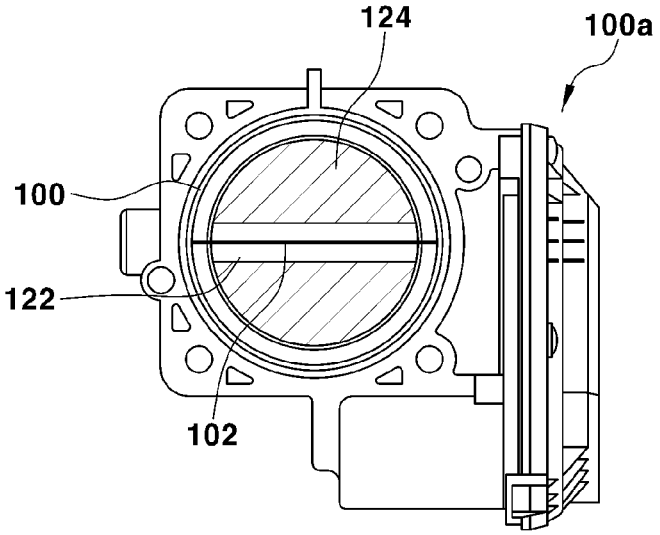
FIG. 4 is a perspective cross-sectional view showing an operation of a heat source of a throttle valve heating control apparatus of an EGR system for a combustion engine according to an embodiment of the present disclosure.

FIG. 3 is a perspective cross-sectional view showing a heat source of a throttle valve heating control apparatus of an EGR system for a combustion engine according to an embodiment of the present disclosure. FIG. 4 is a perspective cross-sectional view showing an operation of a heat source of a throttle valve heating control apparatus of an EGR system for a combustion engine according to an embodiment of the present disclosure.

As shown in FIG. 1, a vehicle engine system (hereinafter "engine system") may include an engine 20, a turbocharger 30, and an EGR system.

The engine 20 may include a plurality of combustion chambers 21 for generating driving force by burning fuel.

The engine 20 may include an intake line 10 in which intake gas supplied to the combustion chambers 21 flows, and an exhaust line 30 in which exhaust gas discharged from the combustion chambers 21 flows.

The exhaust line 30 may include an exhaust gas post-processing device 40 for purifying various hazardous substances contained in exhaust gas discharged from the combustion chambers 21, and in particular, may be configured to purify nitrogen oxides, carbon deposits, and a particulate material (PM) that are introduced from exhaust gas through the warm up catalytic converter (WCC) post-processing device 40.

A turbocharger 50 may compress intake gas (outside air+recirculation gas) introduced through the intake line 10 and may supply the compressed gas to the combustion chambers 21.

The turbocharger 50 may be included in the exhaust line 30, and may include a turbine 51 rotated by exhaust gas discharged from the combustion chambers 21 and a compressor 52 rotated in conjunction with the turbine 51 and configured to compress intake gas.

The EGR system may include a recirculation line 70, an EGR cooler 60, an EGR valve 80, an EM filter 90, and a throttle valve 120.

The recirculation line 70 may be branched from the exhaust line 30 at a rear end of the turbocharger 50 and may merge into the intake line 10.

The EGR cooler 60 may be disposed at the recirculation line 70 and may cool recirculation gas (exhaust gas) flowing along the recirculation line 70.

The EGR system may include the EGR valve 80 that is installed at one end of the EGR cooler 60 and is capable of opening and closing to control a flow rate of recirculation gas (exhaust gas) flowing in the EGR system, and the EM filter 90 that is installed at one end of the EGR valve 80 and is configured to purity residual carbon oxides, nitrogen oxides, and PM that are contained in recirculation gas (exhaust gas).

The EM filter 90 may be a component for filtering foreign substances in order to prepare for the case in which a component such as a catalyst is damaged.

The EGR valve 80 may be connected to a discharge pipe and may allow EGR gas to selectively move through an opening or closing operation, and the throttle valve 120 may be installed at a valve housing 100*a* in which a valve flow channel 110 is formed and a valve housing 100*a* to allow outside air to be introduced through opening or closing.

A motor for operating the throttle valve 120, a circuit for receiving a signal from an ECU and supplying power to the motor, and a sensor for measuring an operating state of the throttle valve 120 may be installed in the valve housing 100*a*.

As shown in FIGS. 3 and 4, the throttle valve 120 may be opened and closed by including a rotation shaft 122 rotatably installed on the valve flow channel 110 and a flap 124 shaped like a disc installed on the rotation shaft 122, and the valve housing 100*a* may include a heat source 100 installed therein.

The heat source 100 may be operated when receiving a voltage from a battery of a vehicle.

That is, a front end of the EGR valve 80 is always exposed to EGR gas at 80° C. to 180° C. and outside air at low temperature does not easily flow toward the EGR valve 80 due to such flow of the EGR gas, and thus the EGR valve 80 may not freeze. However, the throttle valve 120 may easily freeze due to a temperature difference between the EGR gas and outside air, and to this end, according to an embodiment, the heat source 100 may be installed to heat the throttle valve 120.

In particular, the heat source 100 may include a positive temperature coefficient (PTC) heater formed like a film having a predetermined thickness and may be installed on an inner circumference of the valve housing 100*a*.

Upon receiving a voltage from a battery, the heat source 100 generates heat, and thus may transfer heat to the inside of the valve housing 100*a* formed of aluminum.

In particular, a thermal conductor 102 formed like a bar is installed at the rotation shaft 122 to contact the heat source 100 (refer to FIGS. 3 and 4), and thus when a voltage of the battery is applied to the heat source 100, heat of the heat source 100 may be transferred to the thermal conductor 102.

That is, as the voltage of the battery of the vehicle corresponds to a preset condition while a temperature of outside air of the vehicle is low, the heat source 100 may be selectively operated through a controller 400, and the thermal conductor 102 may also generate heat due to the heat that is transferred as the heat source 100 is operated, and accordingly, the rotation shaft 122 and the flap 124 installed on the rotation shaft 122 may be prevented from freezing.

In other words, when outside air is introduced into the valve housing 100*a* in a condition in which outside air is at low temperature of −20° C. to −10° C., the flap 124 may freeze due to a high temperature difference between exhaust gas at high temperature and outside air at low temperature.

As such, when the flap 124 freezes, this may act as friction in the valve housing 100*a* while the EGR valve 80 is operated and a problem occurs in terms of control, and a lump of ice may be introduced into the turbocharger 50 connected to the flap 124 and may damage the turbocharger 50.

To this end, according to the present embodiment, when the voltage of the battery is selectively applied to the heat source 100 as a predetermined condition is satisfied, heat may be transferred to the thermal conductor 102 due to heat generated by the heat source 100, and the aforementioned problem in terms of freezing may be effectively overcome.

Here, the thermal conductor 102 may generate heat due to the heat transferred from the heat source 100 rather than directly generating heat by the battery, and thus the thermal conductor 102 may be prevented from deteriorating while being exposed to heat for a long time and from being changed in its material properties due to repeatedly applied thermal stress.

The heat source 100 may be selectively operated as the temperature of outside air and the voltage satisfy a predetermined condition, and to this end, as shown in FIG. 2, the controller 400 may receive information on the temperature of outside air and the voltage from a first sensor unit 200 and a second sensor unit 300, respectively, and may control an operation of the heat source 100.

The first sensor unit 200 may be configured to measure the temperature of outside air of the vehicle and the second sensor unit 300 may also be configured to measure the voltage of the battery of the vehicle.

The controller 400 may control an operation of the heat source 100 to selectively apply the voltage of the battery of the vehicle to the heat source 100 as the temperature of outside air and the voltage satisfy a predetermined condition in the state in which the vehicle is turned on and may determine whether the operation of the heat source 100 is maintained by re-comparing the predetermined condition with the temperature of outside air in the state in which the heat source 100 is operated.

That is, in the state in which the vehicle is turned on, when the temperature of outside air transmitted from the first sensor unit 200 is equal to or less than a setting temperature and the voltage of the battery of the vehicle transmitted from the second sensor unit 300 is also equal to or less than the setting voltage, since the current state is the state in which the temperature of outside air is low, the controller 400 needs to operate the heat source 100, and in this state, when the voltage of the battery is equal to or greater than the setting voltage, a problem occurs in that the heat source 100 is damaged due to a low initial resistance value and overcurrent when a voltage is applied in the state of an overvoltage, and thus the controller 400 may control the heat source 100 to be selectively operated only when the voltage of the battery corresponds to a normal voltage.

Here, information on the temperature of outside air measured by the first sensor unit 200 may be substituted with information on a temperature of intake air measured through an intake air temperature sensor when abnormality occurs in the first sensor unit 200.

The controller 400 may determine whether the operation of the heat source 100 is maintained by re-comparing a setting temperature with the temperature of outside air in the state in which the heat source 100 is operated.

Here, in the case of the setting temperature to be re-compared with the temperature of outside air, the predetermined condition may be set to be higher than a setting temperature to be previously compared.

This is because, when the temperature of outside air is changed to a relatively high temperature, the operation of the heat source 100 is not required, and thus application of the voltage of the battery needs to be selectively terminated by re-comparing the above temperature with another setting temperature.

As a result, according to the present embodiment, whether application of the voltage of the battery is maintained or terminated may be determined by comparing the temperature of outside air for the operation of the heat source 100 and the temperature of outside air for terminating the operation of the heat source 100 with different setting temperatures, respectively, and thus hysteresis due to frequent on/off at one boundary temperature, which conventionally occurs, may be prevented.

Figure 5:
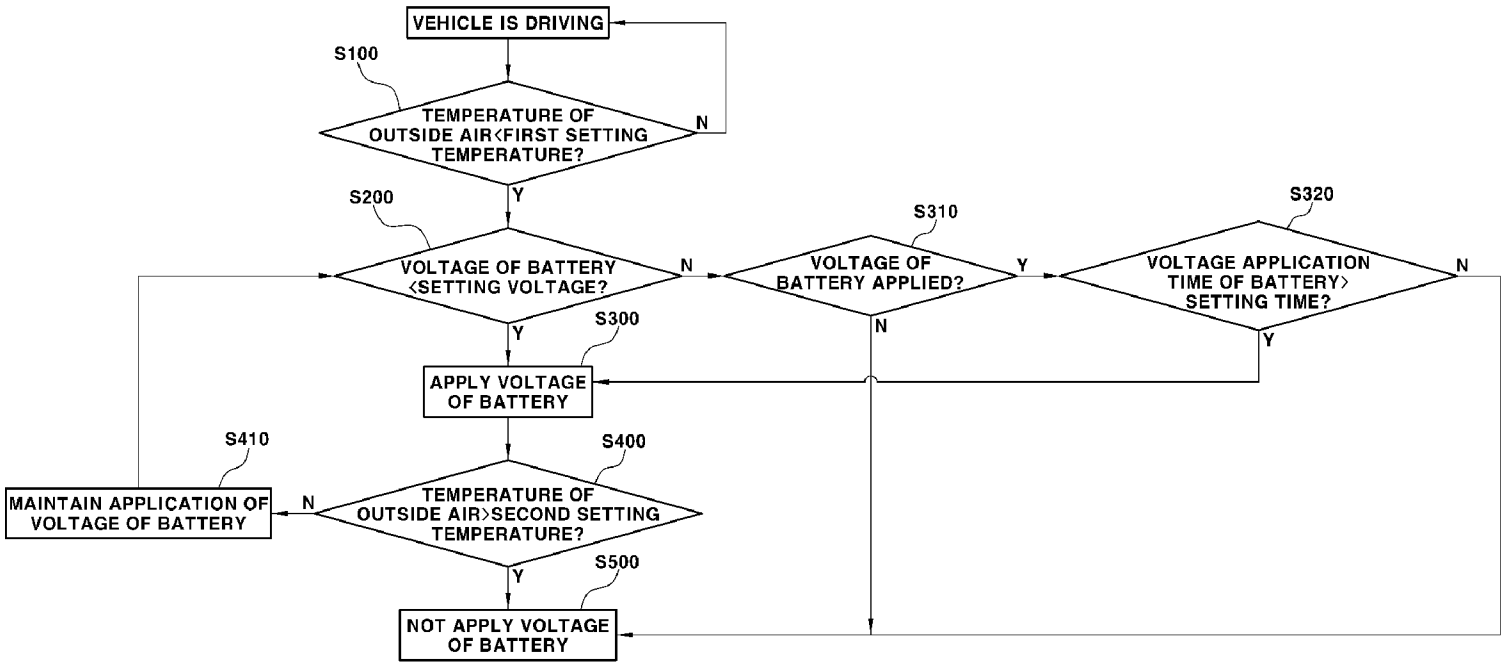
FIG. 5 is a diagram showing sequential control of a throttle valve heating control apparatus of an EGR system for a combustion engine according to another embodiment of the present disclosure.

FIG. 5 is a diagram showing sequential control of a throttle valve heating control apparatus of an EGR system for a combustion engine according to another embodiment of the present disclosure.

With reference to FIG. 5, a valve heating control method of an EGR system for a combustion engine according to an embodiment of the present disclosure will be sequentially described.

First, in the state in which the vehicle is turned on, the temperature of outside air may be measured by the first sensor unit 200 and may be compared with a first setting temperature (S100).

When the temperature outside air is equal to or greater than the first setting temperature, since a temperature difference between exhaust gas and outside air is low, the possibility that freezing occurs is low, and thus the heat source 100 may not be operated.

In this case, when the temperature of outside air is equal to or less than the first setting temperature (S100), the voltage of the battery of the vehicle may be measured by the second sensor unit 300 and may be compared with a setting voltage (S200).

In this case, when the temperature of outside air is equal to or less than the first setting temperature (S100) and the voltage of the battery is also equal to or less than a setting voltage (S200), since the current state is the state in which the temperature of outside air is low, freezing occurs, but since the voltage of the battery is equal to or less than the setting voltage, the heat source 100 may be prevented from being damaged due to overcurrent, and thus the controller 400 may perform control to apply the voltage to the heat source 100 (S300).

As such, as the voltage of the battery is applied to the heat source 100 (S300), the heat source 100 and the thermal conductor 102 may generate heat to prevent freezing due to a temperature difference between exhaust gas and outside air.

Then, when the voltage of the battery is applied to the heat source 100, the controller 400 may compare the temperature of outside air with a second setting temperature (S400), when the temperature of outside air is equal to or less than the second setting temperature, the controller 400 may perform control to maintain application of the voltage of the battery (S410), and as such, in the state in which the application of the voltage of the battery is maintained, the controller 400 may perform control to repeatedly perform the battery voltage comparison operation S200.

This is because, in the state in which application of the voltage of the battery is applied, the voltage of the battery may be repeatedly compared with the setting voltage, and as the voltage of the battery is increased, application of the voltage of the battery may be selectively terminated, and accordingly, the heat source 100 needs to be prevented from being damaged due to overcurrent.

As the measurement result of the temperature of outside air, when the temperature of outside air is equal to or greater than the second setting temperature set to be higher than the first setting temperature, the controller 400 may determine that the possibility that freezing occurs is low due to a temperature difference between exhaust gas and outside air and may perform control to terminate application of the voltage of the battery and to maintain the state in which a voltage is not applied to the heat source 100 (S500).

When the temperature of outside air is equal to or less than the first setting temperature (S100) and the voltage of the battery is also equal to or greater than the setting voltage (S200), the controller 400 may perform control to determine whether the voltage of the battery is applied (S310).

While the battery voltage comparison operation S200 is repeatedly performed in the state in which application of the voltage of the battery is maintained, when the voltage of the battery is equal to or greater than the setting voltage (S200), the heat source 100 may be damaged due to overcurrent, and thus the heat source 100 may be prevented from being damaged by determining whether the voltage of the battery is applied in this state (S310).

In this case, as the determination result of whether the voltage of the battery is applied (S310), when the current state is determined as the state in which the voltage is applied, the controller 400 may compare a voltage application time of the battery, containing a time during which the battery voltage comparison operation S200 is repeatedly performed, with a setting time (S320), and when the voltage application time is equal to or greater than the setting time, the controller 400 may perform control to apply the voltage of the battery to the heat source 100.

This is because, when the voltage application time of the battery is equal to or greater than the setting time during the operation of the heat source 100, as the operating time elapses, the temperature of the battery increases, and in this case, the current state may be determined as the state in which resistance is high and current is low, and thus when a voltage is applied to the heat source 100 in this state, the problem of the heat source 100 being damaged due to application of overcurrent may not occur.

In particular, the setting time may be preset to a time consumed until a steady state that is differently set depending on the capacity of the heat source 100 is reached.

In contrast, the controller 400 may compare the voltage application time of the battery, containing the time during which the battery voltage comparison operation S200 is repeatedly performed, with the setting time (S320), and when the voltage application time of the battery is equal to or less than the setting time, since the current state is the state in which the temperature of the battery is relatively low, the current state is the state in which resistance is low and current is high, that is, overcurrent may be applied to the heat source 100, and accordingly, the controller 400 may perform control to terminate application of the voltage of the battery and to maintain the state in which a voltage is not applied to the heat source 100, thereby preventing the problem of the heat source 100 being damaged due to application of overcurrent.

According to the present disclosure, the problem of a heater being damaged due to overcurrent may be prevented and the problem of the inside of a valve housing freezing may also be prevented by installing the heater in the valve housing, and applying a voltage to the heater and selectively operating the heater when the temperature of outside air is equal to or less than a setting temperature and the voltage of the battery of the vehicle applied for operating the heater is equal to or less than a setting voltage in the state in which an engine is turned on.

According to the present disclosure, an operation of the heater may be terminated in an outside air condition in which application of the voltage of the battery of the vehicle is not required by determining whether application of the voltage of the battery of the vehicle is maintained through comparison between the temperature of outside air and another setting temperature in the state in which the voltage of the battery of the vehicle is applied to the heater.

Accordingly, according to the present disclosure, a setting temperature of outside air for operating the heater and a setting temperature of outside air for terminating the operation of the heater may each be set and whether application of the voltage of the battery of the vehicle is performed or terminated may be determined, and accordingly, hysteresis due to frequent on/off at one boundary temperature may be prevented.

According to the present disclosure, the problem of a heater being damaged due to overcurrent may be prevented and the problem of the inside of a valve housing freezing may also be prevented by installing the heater in the valve housing, and applying a voltage to the heater and selectively operating the heater when the temperature of outside air is equal to or less than a setting temperature and the voltage of the battery of the vehicle applied for operating the heater is equal to or less than a setting voltage in the state in which an engine is turned on.

According to the present disclosure, an operation of the heater may be terminated in an outside air condition in which application of the voltage of the battery of the vehicle is not required by determining whether application of the voltage of the battery of the vehicle is maintained through comparison between the temperature of outside air and another setting temperature in the state in which the voltage of the battery of the vehicle is applied to the heater.

Accordingly, according to the present disclosure, a setting temperature of outside air for operating the heater and a setting temperature of outside air for terminating the operation of the heater may each be set and whether application of the voltage of the battery of the vehicle is performed or terminated may be determined, and accordingly, hysteresis due to frequent on/off at one boundary temperature may be prevented.

The invention has been described in detail with reference to preferred embodiments thereof. However, it will be appreciated by those skilled in the art that changes may be made in these embodiments without departing from the principles and spirit of the present disclosure, the scope of which is defined in the appended claims and their equivalents.

What is claimed is:

1. A throttle valve heating control apparatus of an exhaust gas recirculation (EGR) system for a combustion engine, comprising:

a heat source installed in a valve housing and operated upon receiving a voltage from a battery of a vehicle;

a first sensor unit configured to measure a temperature of outside air of the vehicle;

a second sensor unit configured to measure the voltage of the battery; and a controller configured to selectively control an operation of the heat source in response to determining that the temperature of outside air is equal to or less than a first setting temperature and the voltage is equal to or less than a setting voltage with the vehicle turned on, and to determine whether an operation of the heat source needs to be maintained by further comparing the temperature of outside air with a second setting temperature which is higher than the first setting temperature while the heat source is operating.

2. The apparatus of claim 1, wherein the heat source comprises a positive temperature coefficient (PTC) heater formed like a film and installed on an inner circumference of the valve housing.

3. The apparatus of claim 2, wherein the heat source transfers heat to a thermal conductor of a rotation shaft rotatably installed on a valve flow channel of the valve housing upon receiving the voltage of the battery.

4. A throttle valve heating control method of an exhaust gas recirculation (EGR) system for a combustion engine, comprising:

measuring an outside air temperature and comparing the outside air temperature with a first setting temperature when a vehicle is turned on;

measuring a voltage of a battery of the vehicle and comparing the voltage with a setting voltage in response to determining that the outside air temperature is equal to or less than the first setting temperature; and controlling a heat source operation such that the voltage of the battery is selectively applied to a heat source installed inside a valve housing in response to determining that the outside air temperature is equal to or less than the first setting temperature and the voltage of the battery is equal to or less than the setting voltage, wherein the controlling of the heat source operation further comprises an outside air temperature re-comparison operation of comparing the outside air temperature with a second setting temperature when receiving the voltage of the battery, and performing control to maintain application of the voltage of the battery and to repeatedly perform the battery voltage comparison operation in response to determining that the outside air temperature is equal to or less than the second setting temperature, and wherein the second setting temperature is set to be higher than the first setting temperature.

5. The method of claim 4, wherein the outside air temperature re-comparison operation comprises performing control to terminate application of the voltage of the battery when the outside air temperature is equal to or greater than the second setting temperature.

6. The method of claim 4, wherein the controlling the heat source operation comprises determining whether the voltage of the battery is applied when the voltage of the battery is equal to or greater than the setting voltage.

7. The method of claim 6, wherein the determining comprises a voltage application time comparison operation of comparing a voltage application time of the battery, containing a time during which the battery voltage comparison operation is repeatedly performed, with a setting time and performing control to selectively apply the voltage to the battery when determining that the voltage of the battery is applied.

8. The method of claim 7, wherein the voltage application time comparison operation comprises performing control to apply the voltage of the battery when the voltage application time of the battery is equal to or greater than the setting time.

9. The method of claim 7, wherein the voltage application time comparison operation comprises performing control to terminate application of the voltage of the battery when the voltage application time of the battery is equal to or less than the setting time.

* * * * *